US005293864A

United States Patent [19]

McFadden

[11] Patent Number: 5,293,864

[45] Date of Patent: Mar. 15, 1994

[54] EMERGENCY BREATHING APPARATUS

[75] Inventor: James E. McFadden, Germantown, Md.

[73] Assignee: GEOMET Technologies, Inc., Germantown, Md.

[21] Appl. No.: 739,066

[22] Filed: Aug. 1, 1991

[51] Int. Cl.[5] ..... A62B 17/00

[52] U.S. Cl. ..... 128/201.29; 128/202.12; 128/205.24

[58] Field of Search ..... 128/201.22, 201.24, 128/201.25, 201.23, 201.28, 201.29, 201.27, 202.12, 202.11, 202.19, 205.26, 205.24, 202.22

[56] References Cited

U.S. PATENT DOCUMENTS

| | | | |
|---|---|---|---|
| 2,814,290 | 11/1957 | Holmes | 128/202.11 |
| 3,190,287 | 6/1965 | Miller, Jr. | 128/202.11 |
| 3,628,531 | 12/1971 | Harris | 128/202.11 |
| 4,328,798 | 5/1982 | Isaacson | 128/202.27 |
| 4,619,255 | 10/1986 | Spinosa et al. | 128/202.27 |
| 4,841,953 | 6/1989 | Dodrill | 128/202.27 |
| 4,847,914 | 7/1989 | Suda | 128/205.29 |
| 4,881,539 | 11/1989 | Pasternack | 128/201.27 |
| 5,027,807 | 7/1991 | Wise et al. | 128/201.29 |

*Primary Examiner*—Edgar S. Burr
*Assistant Examiner*—Aaron J. Lewis
*Attorney, Agent, or Firm*—Diller, Ramik & Wight

[57] ABSTRACT

An EBA system is provided which includes a primary source of pressurized air, a secondary source of pressurized air, hoses leading the primary and secondary sources of pressurized air to an EBA valve, and two hoses for directing pressurized air to the interior of a protective suit for over-pressurization and to a mouthpiece of a user. The valve is constructed and arranged to operate under two modes of operation, in one of which air from the primary air source is directed to an over-pressurization hose and an inhalation hose while air from the secondary air source hose is blocked, and a second mode in which air from the secondary or auxiliary supply is directed to the inhalation hose but not to the pressurization hose.

30 Claims, 4 Drawing Sheets

EMERGENCY BREATHING APPARATUS

BACKGROUND OF THE INVENTION

The present invention is directed to an emergency breathing apparatus of the type which includes a protective suit, first and second sources of air, and a valve for selectively directing the air from either of the first and second air sources to an inhalation orifice of the protective suit. A wearer of the protective suit is normally supplied air from the first air source through a relatively long (100 feet) hose or conduit, but should the latter rupture, a valve can be manually operated to cut-off the air flow to the valve from the first hose and cut-in air from the second air source, such as a compressed air tank, to the inhalation orifice of the protective suit. Accordingly, should the first hose to the first air source break or rupture, the secondary air source provides the user a sufficient time period (10 to 30 minutes) to complete whatever might be the task assigned and/or leave the area before the secondary air source has been depleted.

DESCRIPTION OF RELATED ART

Pasternack (U.S. Pat. No. 4,881,539) is an example of a protective suit having two air sources, both portable tanks, but each being designed through appropriate valve mechanisms to direct breathable gas to a helmet of the protective suit.

Isaacson (U.S. Pat. No. 4,328,798) discloses a self-contained breathing apparatus wherein air is directed from a pressurized supply tank to a face mask of a first fire fighter through a pressurized regulator and a demand inhalation valve connected to the face mask by a flexible breathing tube. A check valve and a quick-release coupler unit is connected to the pressure regulator and is adapted to be temporarily connected by an adapter to the flexible breathing tube extending from the face mask of a breathing apparatus of a second fire fighter to provide for a quick supply of emergency air to the second fire fighter.

Dodrill (U.S. Pat. No. 4,841,953) is an example of a portable self-contained breathing apparatus which includes a primary air cylinder and a smaller auxiliary air cylinder each associated with a pressure regulator and both being in fluid/air communication with a face mask. Under normal operation, air from the primary air cylinder passes through its associated pressure regulator and into an interior of the face mask or face piece. However, when the primary source of air is exhausted and/or if there is a malfunction in the primary components, including the primary source pressure reducer and/or the primary source air hose, the user simply rotates an on-off knob of the auxiliary tank to supply air therefrom through an associated valve to the face piece for consumption by the user. This provides additional air and breathing time to allow the user to exit an area containing hazardous air or the like.

Spinosa et al. (U.S. Pat. No. 4,619,255) discloses an emergency oxygen system for use on aircraft which includes both a primary oxygen delivery system and an emergency oxygen delivery system, the latter of which is a cylinder of oxygen which automatically cuts-in when the primary source is cut-out, as, for example, in the event of ejection of the user from the aircraft.

SUMMARY OF THE INVENTION

In keeping with the present invention, a novel emergency breathing apparatus is provided in which a primary air source and a secondary air source, such as a portable compressed air tank, are each connected to an EBA (emergency breathing apparatus) valve or switch, and two outlets therefrom are connected to an inhalation port/mouthpiece of the protective suit and to an interior of the protective suit for over-pressurizing the same.

In a first mode of operation, air from the first or primary air source is directed through the EBA valve or switch to the inhalation port/mouthpiece and to the protective suit interior while at the same time air from a portable compressed air tank (secondary air source) is cut-off. The EBA valve includes a housing which carries an indicator which visually indicates the first mode of operation.

Should the primary air source become depleted or the hose therefrom leading to the EBA switch rupture, a manually operated valve of the EBA switch is moved to a position at which air from the primary air source is prevented from entering the EBA valve and air from the compressed air tank is directed to the inhalation port/mouthpiece without any air being directed to pressurize the protective suit. Therefore, the limited amount of air in the portable air tank (second air source) is utilized strictly for breathing purposes. This second mode of operation is also visibly indicated by the indicator of the EBA switch.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
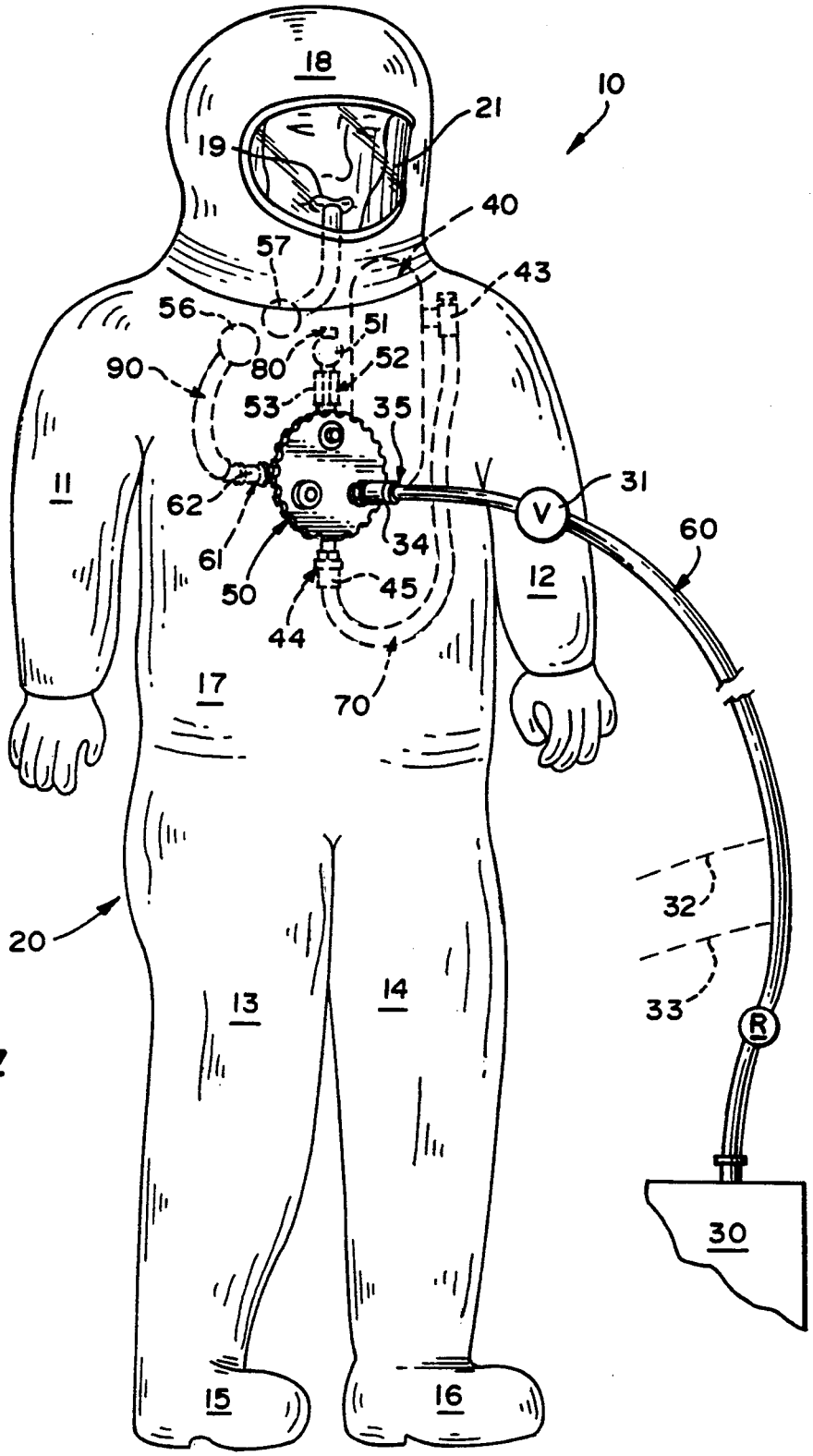
FIG. 1 is a perspective view of a novel emergency breathing system of the present invention, and illustrates primary and secondary air sources for directing air through associated hoses to an EBA valve mechanism and from the latter selectively to an inhalation hose and/or an over-pressurization hose of a protective suit and the user therein.

A novel emergency breathing apparatus system (hereinafter EBA system) constructed in accordance with this invention is illustrated in FIG. 1 of the drawings, and is generally designated by the reference numeral 10.

The EBA system 10 includes a protective suit 20, a first source of air 30, a second source of air 40, an emergency breathing apparatus valve mechanism or switch (hereinafter EBA switch) 50, and first through fourth conduit means or hoses 60, 70, 80 and 90, respectively.

The protective suit 20 is essentially of a conventional construction, as, for example, the type disclosed in U.S. Pat. No. 4,847,914 grated Jul. 18, 1989 and entitled GARMENT FOR PROTECTING AGAINST ENVIRONMENTAL CONTAMINATION or various ones of the protective garments set forth in the patents listed therein under "Background of the Invention." Essentially, the protective suit or protective garment 20 includes a pair of arms 11, 12; a pair of legs 13, 14; feet 15, 16 associated with the respective legs 13, 14; a body section 17; and a separate, removable hood or headpiece 18 having a transparent window or visor 21.

The first air source 30 is a relatively large (15,000 cubic feet) tank of air at between 200–300 p.s.i. which is reduced to approximately 85–90 p.s.i. through an associated conventional regulator R in the first hose or conduit means 60. The hose 60 is relatively long (100 feet or more) and is connected directly to the EBA switch 50 through a conventional air pressure flow regulator 31 which can be manually adjusted by the user to a desired air pressure below the 85–90 p.s.i. downstream of the regulator R. While the EBA system 10 is shown in FIG. 1 associated with a single protective suite 20, it is to be understood that branch lines or hoses 32, 33, for example, can be connected by T-fittings (not shown) to the hose 60 and in turn connected to additional unillustrated EBA systems through associated adjustable air pressure regulators, such as the regulator 31. In this manner, two or more individuals in two or more EBA systems 10 can be supplied air from the single primary air source 30 and operate essentially on a buddy-to-buddy system when in a hostile environment (chemical, fire, smoke, etc.). The hose 60 beyond the adjustable air pressure regulator 31 includes a female coupling 34 of a quick connect/disconnect coupling 35 which connects to a male coupling 36 (FIGS. 2 and 3) having a bore or first inlet means 37. A threaded portion 38 (FIG. 3) of the male coupling 36 is threaded into a threaded bore 41 (FIGS. 2 and 3) of a housing 42 of the EBA switch 50.

The secondary air source 40 (FIG. 1) is an auxiliary source of air, such as a portable compressed air tank which includes a manually operable on-off valve 43 for selectively placing the tank 40 into fluid communication with the second hose or conduit means 70. The hose 70 includes a quick connected/disconnect coupling means 44 defined by a female coupling 45 carried by the hose 70 and a male coupling 46 (FIG. 2) having a bore 47 defining a second inlet means of the EBA switch 50.

The over-pressurization or third hose or conduit means 80 includes an adjustable valve 51 for regulating the air pressure and flow therethrough and into an interior (unnumbered) of the protective suit 20. The valve 51 is of a conventional construction and is manually adjusted to selectively over-pressure the protective suit 20 to a desired pressure. One end of the relatively short over-pressure hose 80 opens into the interior of the protective suit 20, while an opposite end (unnumbered) of tee hose 80 is connected to the valve 51 which is in turn connected to the EBA switch 50 by quick connect/disconnect means 52 which includes a female coupler or coupling 53 and a male coupler or coupling 54 having a bore 55 therethrough defining a pressurized air outlet of the EBA switch 50.

The inhalation hose or fourth conduit means 90 includes an end portion (unnumbered) adjacent the visor 21 of the headpiece 18 for directing inhalation air into a mouthpiece 19 held in the mouth of the user. A manually adjustable fluid pressure regulator 56 and a filter 57 are conventionally provided in the hose 90. The hose 90 is connected to the EBA switch 50 through quick connect/disconnect means 61 defined by a female coupler or coupling 62 and a male coupler or coupling 63 having a bore 64 formed therein defining another outlet of the EBA switch 50.

Referring specifically to FIGS. 2 through 5 of the drawings, the switch housing 42 of the EBA switch 50 is of a generally cylindrical configuration defined by a circular front face 71, a rear face 72, a rear cylindrical portion 73, a front threaded cylindrical portion 74 and an intermediate radially outwardly directed peripheral flange 75. The flange 75 seats against an interior surface (unnumbered) of fabric F from which the protective suit 20 is constructed with the front threaded cylindrical portion 74 projecting through an opening O thereof. Adhesive (not shown) is applied to an exterior surface of the fabric F adjacent the opening O and a flexible ring gasket 76 is applied against an exterior surface of the adhesive. A relatively rigid gasket ring 77 is slipped over the front threaded cylindrical portion 74 and is brought into bearing engagement with the flexible ring gasket 76 by an internally threaded clamping ring 78 threaded upon the front threaded cylindrical portion 74. The latter defines an air tight seal between the EBA switch housing 42 and the fabric F of the protective suite 20 while allowing the housing 42 to be rapidly removed therefrom for purposes of, for example, inspection and/or repair. The latter is accomplished by simply disconnecting all of the quick connect/disconnect means 35, 44, 52 and 61 (FIG. 1), removing the clamping ring 78 and rigid gasket ring 77, and pulling the EBA switch 50 to the right, as viewed in FIG. 3, which draws the front threaded cylindrical portion 74 out of the opening O and the EBA switch 50 into the interior of the protective suit 20 from which it can be removed through an upper opening (not shown) in the area of the user's neck which in FIG. 1 is, of course, covered by the removable hood or headpiece 18. The flexible ring gasket 76 remains, of course, adhered to the exterior surface (unnumbered) of the fabric F by the ring gasket adhesive (not shown). Once repaired and/or inspected and/or reconditioned, the EBA switch 50 can be replaced in the operative position in the manner readily apparent from the latter description simply by essentially reversing the just described disassembly process.

Referring to FIGS. 2, 3, 4, 6 and 7 of the drawings, valve means 100 in the form of a Clippard MJV-3C control valve manufactured by NB Cochrane Co. of Baltimore, Md. is housed within a relatively large diameter bore 101 having a threaded portion 102 and a reduced diameter bore portion 103. The valve 100 is retained in the bore 101 by a valve retainer 109 which bottoms against the valve 100 and is threaded by a threaded portion 104 into the threaded portion 102 of the bore 101. The valve retainer 108 has an internally threaded bore 109, and threaded thereto is a threaded stem (not shown) of the male coupling 46. A gasket 105 seals the bore 101 to atmosphere.

Figure 6:
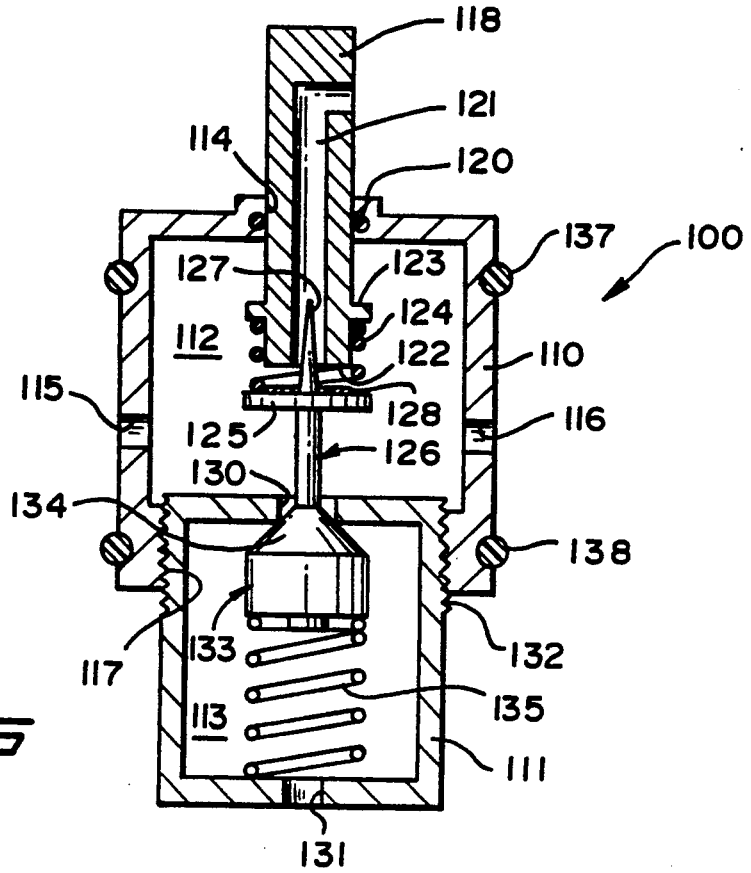
FIG. 6 is a schematic axial sectional view through the valve means of FIGS. 3 and 4, and illustrates the relative position of a valve actuator and a valve stem in the first mode of operation of the EBA system.
Figure 7:
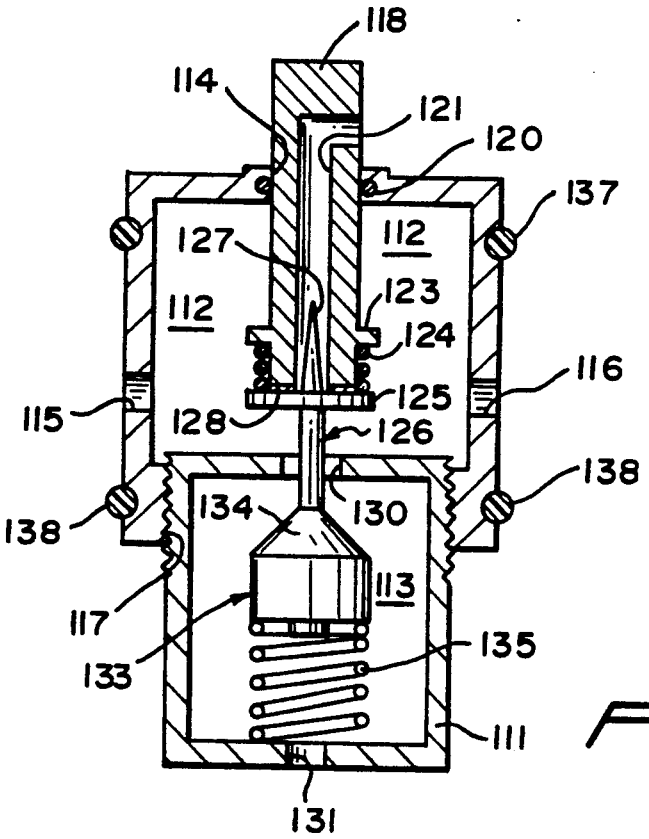
FIG. 7 is a schematic view similar to FIG. 6, and illustrates the position of the valve actuator and the valve stem in the second mode of operation of the EBA system.

The valve 100 is schematically illustrated in FIGS. 6 and 7 and includes an upper valve housing or body 110 and a lower valve housing or body 111 defining respective valve chambers 112, 113. The upper valve housing 110 includes an upper axial opening 114, diametrically opposite openings, ports or bores 115, 116, and a lower threaded axial bore 117. The axial opening or bore 114 receives a valve actuator or stem 118 of a generally cylindrical configuration which matches the diameter of the opening 114 and is sealed by a conventional O-ring gasket 120. A port 121 opens at an upper end thereof exteriorly of the upper valve housing 111 and interiorly of the upper valve housing 110 opens through a radial face or valve seat 122 (FIG. 6). The valve actuator 118 includes a radially outwardly directed flange or shoulder 123 against which bottoms a compression spring 124 which also bottoms against a valve head 125 carried by a valve stem 126. A conical centering and aligning terminal end portion 127 of the valve stem 126 is received in the bore 121. The valve head 125 carries a resilient generally flat annular or ring gasket 128 which seals against the valve seat 122 when the components are in the position shown in FIG. 7, as will be described more fully hereinafter.

The lower valve housing 111 includes an upper axial bore 130, a lower axial bore 131, and an external threaded portion 132 which is in threaded engagement with the threaded bore 117. The valve stem 126 and a second valve head 133 forming an integral part thereof and having a conical sealing surface 134 is normally biased to the position shown in FIG. 6 by another compression spring 135.

Figure 3:
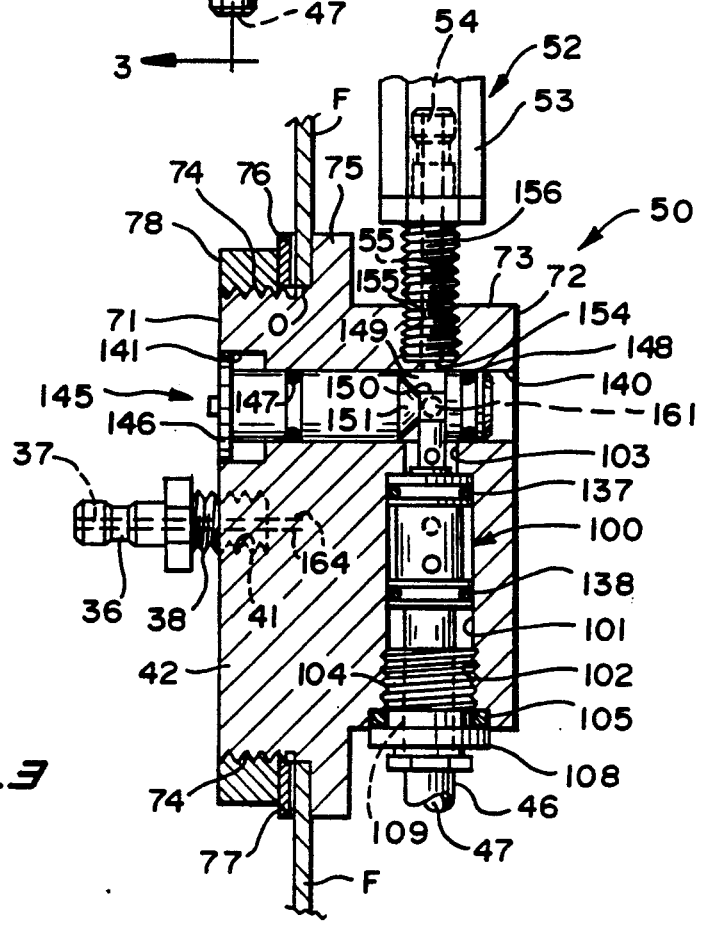
FIG. 3 is a cross-sectional view taken generally along line 3—3 of FIG. 2, and illustrates the manual valve actuator and an associated valve means in the valve chamber in the first relative positions thereof.
Figure 5:
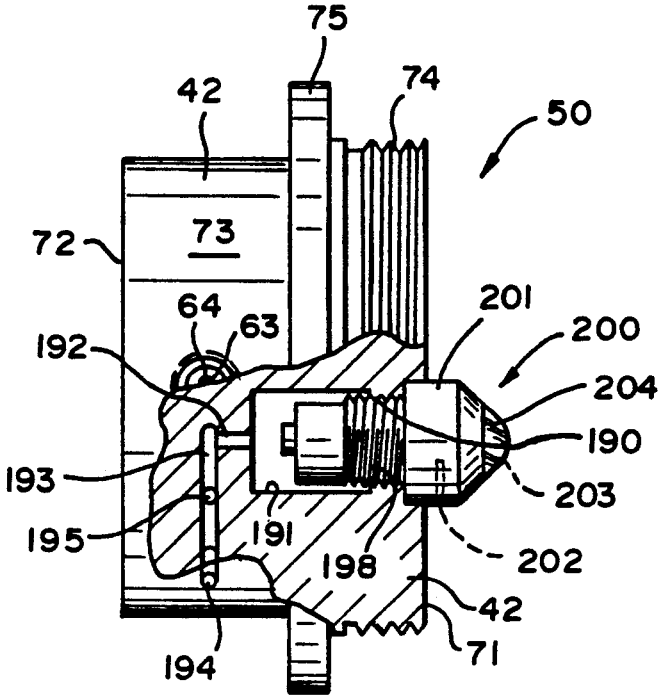
FIG. 5 is a fragmentary cross-sectional view through a portion of a housing of a valve mechanism, and indicates an indicator for visually indicating the first and second modes of operation of the EBA system.

In the position of the valve 100 shown in FIG. 6, air can enter from the exterior of the valve 100 through the bore or port 121 and past the valve seat 122 into the upper valve chamber 112 and outwardly therefrom through the diametrically opposite bores or openings 115, 116 with the exodus of the air therefrom being limited by external O-rings or O-ring gaskets 137, 138 defining a seal between the upper valve housing 110 and the bore 101 (See FIG. 3).

When the valve actuator or stem 118 is depressed (FIG. 7), in the manner to be described more fully hereafter, the spring 124 is compressed, the valve seat 122 seats against the gasket 128 cutting-off communication through the port 121 but opening communication through the bore 130 past the conical surface 134 as the stem 126 is moved downwardly from the position shown in FIG. 6 to the position shown in FIG. 7 which additionally compresses the spring 135. Air is now free to enter from atmosphere through the bore 131 into the chamber 113 and from the latter through the bore 130 into the chamber 112 and outwardly thereof through the diametrically opposite bores 115, 116. However, the air in the chamber 112 is precluded from entering the bore 121 by the seal between the valve seat 122 of the actuator stem 118 and the ring gasket 128 carried by the valve head 125.

Figure 2:
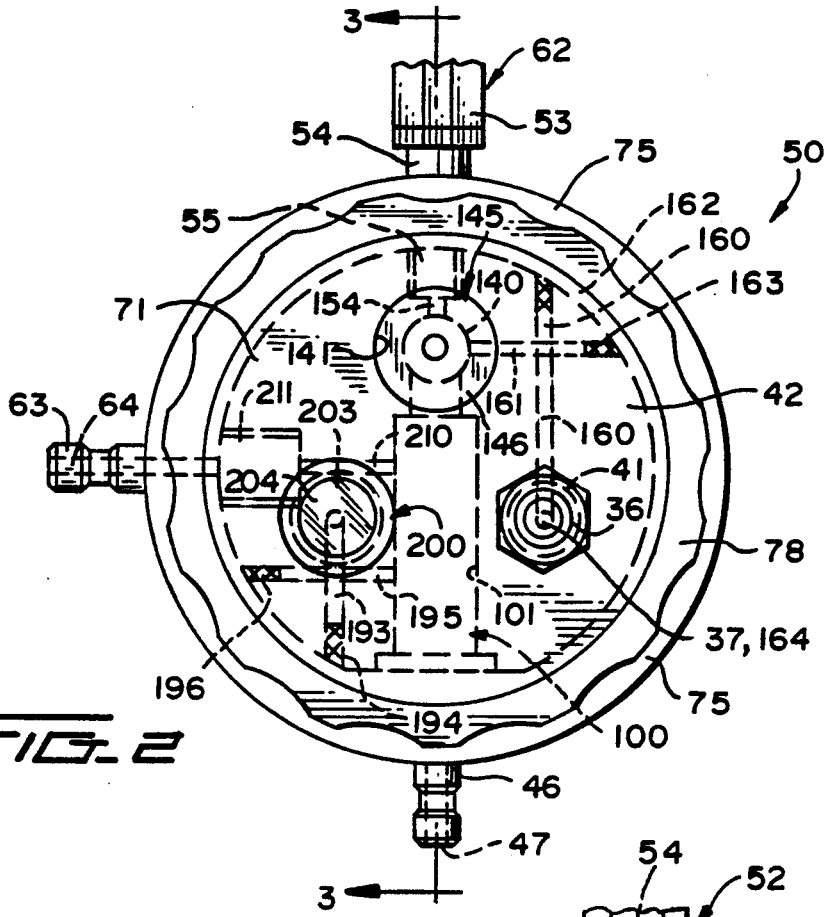
FIG. 2 is an enlarged front elevational view of the EBA valve mechanism or switch, and illustrates two inlets and two outlets in the form of quick connect/disconnect couplings, a manually operable actuator, a visual indicator, and an associated valve chamber.

As is best illustrated in FIG. 3, the upper end (unnumbered) of the stem 118 projects into a cylindrical bore 140 having a counterbored portion 141 with the axis of the latter being normal to the axis of the valve 100 and the bores 114, 130, 131, as well as normal to the direction of axial movement of the valve stem 126. Housed within the bore 140 and the counterbore 141 is manually operable means in the form of a reciprocal slidable spool valve 145 having an enlarged flange 146 immediately adjacent the front surface 71 (FIG. 3) of the EBA switch housing 42. O-ring gaskets 147, 148 seal a central bore portion 149 of the bore 140 to atmosphere, and a medial portion (unnumbered) of the spool valve 145 is provided with a reduced cylindrical neck portion 150 and a frusto-conical camming surface 151. (In FIGS. 3 and 6 the valve actuator 118 is in its uppermost extended position, but when the spool valve 145 is manually pushed to the right from the position shown in FIG. 3 to the position shown in FIG. 4 by a user, the cam surface 151 pushes the valve actuator or stem 118 downwardly from the position shown in FIG. 6 to the position shown in FIG. 7 for reasons to be described more fully hereinafter.) The bore portion 149 is also placed in fluid communication with the outlet port or bore 55 of the male coupling 54 by a bore 154 (FIGS. 2 and 3). The bore 154 is counterbored and threaded at 155 to receive a threaded stem 156 of the male coupling 54.

The cylindrical portion 73 is bored from its exterior to form two bores 160, 161 (FIG. 2) which have intersecting axes and which are respectively plugged at 162, 163. The bore 161 opens into the bore 140 in the central bore portion 149 thereof (FIG. 3) irrespective of the position of the spool valve 145. The bore 160 merges with a bore 164 (FIG. 3) drilled from the front 71 of the housing 42 which in turn merges with the counterbored threaded portion 41 into which is threaded the threaded portion 38 of the male coupling 36.

The front 71 of the EBA housing 42 includes a threaded bore 190 (FIG. 5) and a bore 191 which is in turn in fluid communication with a bore 192 which is in turn in fluid communication with a bore 193 generally normal to the bore 192. The bore 193 is formed by drilling from the exterior of the rear cylindrical portion 73 and then closing the bore 193 with an appropriate sealing plug 194. Another bore 195 (FIGS. 2 and 5) is drilled from the exterior of the rear cylindrical portion 73, intersects the bore 193 and opens into the bore 101 between the gaskets 137, 138 of the valve 100. A threaded end portion 198 (FIG. 5) of a rotowink indicator 200 is threaded into the threaded portion 190 after an annular adapter ring 201 having a downwardly opening vent hole 202 has been slipped over the threaded portion 198. The rotowink indicator 200 is manufactured by Norgren of Littleton, Colo. and is a spring-loaded device actuated by air pressure to visually monitor pneumatic or fluidic circuits. The indicator 200 includes a ball 203 of two contrasting fluorescent colors (red and green, for example) on opposite hemispheres thereof. The state of the fluidic circuit (unpressurized or pressurized) can be seen at a glance through a wide angle lens 204. The preferred rotowink indicator for visually indicating the pressurized or unpressurized condition of the fluidic circuit to be described hereinafter is preferably Model 5VS-112-000 which is red when unpressurized and green when pressurized. A spring (not shown) normally holds the ball 203 in the unpressurized red position, but when the bore 191 is pressurized, the latter pressure changes/rotates the ball to its pressurized "green" position.

A final bore 210 is formed in the body 42 which opens into the bore 101 between the ring gaskets 137, 138 and also opens in a threaded bore 211 into which is threaded the male coupling 73.

EBA SYSTEM OPERATION

The EBA system 10 will be described assuming that the spool valve 145 is in the position shown in FIGS. 1 through 3 of the drawings at which the valve actuator or stem 118 is extended upwardly (FIG. 6), the valve head 125 is spaced from the valve seat 122, and the bore 130 is closed by the conical surface 134 of the valve head 133.

High pressure air from the primary air source 30 is conducted through the high pressure hose 60 and is appropriate reduced to a desired air pressure by the regulator 31 and flows therethrough and through the quick connected/disconnect coupling means 35 into the bore or first inlet means 37 of the male coupler 36 (FIGS. 2 and 3). The air flows through the bore or first inlet means 37 successively into the bore 134 (FIG. 3), the bore 160 (FIG. 2), the bore 161 and into the bore 140 at the central bore portion 149 in the area of the reduced neck portion 150. The air flows through the bore 154 (FIGS. 2 and 3) into the bore or second outlet 55 of the male coupling 54 of the quick connect/disconnect means 52 and through the pressure regulator 51 (FIG. 1) into the interior of the protective suit 20 to over-pressurize the same.

Air in the bore 140 (FIG. 3) in the area of the central bore portion 149 also travels into the bore 103 (FIG. 3), the bore 121 (FIGS. 3 and 6) of the valve actuator stem 118 (FIG. 6) and passes into the upper valve chamber 112 through the gap between the valve seat 122 and the valve head 125 spaced therefrom under the biasing force of the compression spring 124. The air in the upper valve housing 112 exits the same through the diametrically opposite bores 115, 116 and enters the bore 101 between the O-ring gaskets 137, 138 (FIG. 3). Both of the bores 195, 210 (FIG. 2) are in fluid communication with the area externally of the upper valve housing 110 between the O-ring gaskets 137, 138. Accordingly, air entering the bore 210 flows into the bore 211, the bore 64 of the male coupling 63 of the quick disconnect coupling means 61, enters the hose 90 (FIG. 1) and passes through the regulator 56 and the valve 57 into the mouthpiece 19 (or face mask) of the user. The same pressurized air flows from the bore 195 into the bore 193 (FIGS. 2 and 5) and into the successive bores 192, 191 to pressurize the latter and change the indicator ball 203 from its previous unpressurized ("red") position to its pressurized ("green") position. Accordingly, the "green" visual indication indicates proper air flow over the flow paths heretofore defined to pressurize the interior of the protective suit 20 via the hose 80 and to provide inhalation air via the hose 90. Since the bore 130 (FIG. 6) is closed by the conical sealing seat 134 of the valve head 133, air in the upper valve chamber 112 cannot enter the lower valve chamber 113 and, therefore, cannot flow into the hose 70. By the same token, even if the valve 43 (FIG. 1) were open, air from the secondary or auxiliary source 40 flowing into the nose 70, the quick connect/disconnect means 44 and the bore or inlets 47, 109 (FIGS. 2 and 3) and 131 (FIG. 6) could only reach the interior 113 of the lower valve housing 111 because of the closure of the bore 130 by the conical sealing surface 134 of the valve head 133. Accordingly, in this first mode of operation, the user of the EBA system 10 is supplied with over-pressure air for the protective suit 20 through the hose 80 and with inhalation air through the hose 90 while other air flow is cut-off, and the proper pressurization of this first mode of operation is reflected by the "green" hemisphere of the indicator ball 203 of the indicating means 200.

Assuming that the primary air source 30 becomes depleted or the primary line 60 breaks or that the quick connect/disconnect means 35 disconnects, there will be an abrupt pressure drop essentially to atmospheric at the inlet port or bore 37 (FIGS. 2 and 3). The EBA switch 50 will essentially depressurize to atmospheric pressure by air flow generally opposite that heretofore described. For example, with the hose 60 severed, any air under pressure in the EBA switch 50 will bleed to atmosphere through the broken end of the hose 60. Such bleeding will take place from the bore 191 (FIG. 5) over a flow path including the successive bores 192, 193, 195, the bore 101 between the O-ring gaskets 137, 138, the diametrically opposite bores 115, 116 (FIG. 6), the upper valve chamber 112, the space between the valve seat 122 and the first valve head 125 which remains in its open position under the bias of the spring 124, the port 121, the bore portion 149 (FIG. 3) in the area of the reduced neck portion 150, the bore 161 (FIG. 2), the bore 160, the bore 164 (FIGS. 2 and 3), the bore 37 of the male coupling 36 (FIG. 3) Which through the quick connect/disconnect coupling means 35 is connected to the hose 60. Since the chamber or bore 191 (FIG. 5) is no longer pressurized, the spring of the indicator means 200 switches the indicator ball 203 from "green" (safe) to "red" (danger). Obviously, the user of the protective suit 200 will notice a change in pressure, both in the protective suit and in the inhalation line or hose 90, and he will immediately view the indicator means 200, see the "red" danger color of the indicator ball 203, and act appropriately. It should be noted that pressurized air will also exit the inhalation hose 90 through the bore 64 (FIG. 2), the threaded bore 211, and the bore 210 which also opens into the bore 101 between the O-ring gaskets 137, 138. Hence, the user of the protective suit 20 will be fully aware of a depressurization along the line 60 by both depressurization of the protective suit 20 and depressurization of the inhalation line 90. Furthermore, the EBA system 10 is designed for buddy-to-buddy use and, therefore, another one or more users who are adjacent the user whose line 60 is broken will well observe the "red" danger indicator ball 203 and advise the user thereof should the latter not himself/herself be aware thereof.

Figure 4:
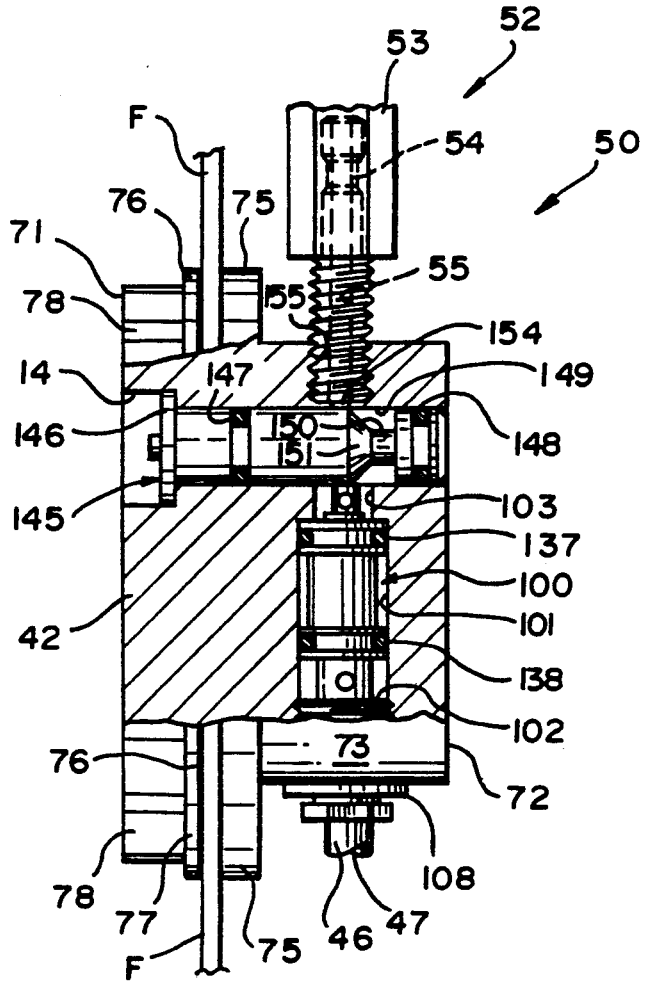
FIG. 4 is a fragmentary cross-sectional view similar to FIG. 3, and illustrates the valve actuator member and the valve means in a second relative position thereof.

When the "red" indicator ball 203 is evident, the user within the protective suit 20 (or his buddy) will push the spool valve 145 from the position shown in FIG. 3 to the position shown in FIG. 4 which is inward relative to the interior of the protective suit 20. This motion causes the cam surface 151 of the spool valve 145 to push the valve actuator or stem 118 downwardly to the position shown in FIGS. 4 and 6 compressing the coil spring 124, closing the gap and forming a seal between the valve seat 122 and the gasket 128 of the valve head 125, and further depressing the valve stem 126 vertically downwardly from the position shown in FIG. 6 to the position shown in FIG. 7 against the bias of the compression spring 135 which unseats the conical sealing surface 134 and opens the port 130.

With the spool valve 145 in the position shown in FIG. 4 and the valve 100 in the position shown in FIG.

7, the main line or hose 60 is cut-off from the inhalation hose 90 by the seal formed between the valve seat 122 and the gasket 128. Therefore, air attempting to descend the bore 121, as viewed in FIG. 7, cannot do so. However, air from the secondary air source or portable tank 40 flows through the hose 70 (FIG. 1) and the quick connect/disconnect coupling means 44 into the bore 47 (FIGS. 2 and 3), the bore 131 (FIG. 7), the lower valve chamber 113 and through the bore 130 into the upper valve chamber 112. The air then flows from the upper valve chamber 112 through the diametrically opposite bores 115, 116 in the manner heretofore described which essentially again directs air through the bores 195, 210 (FIG. 2) in the various bores and hoses associated therewith to introduce air into the inhalation hose 90 and pressurized air into the bore or chamber 191 (FIG. 5), the latter of which again changes the unpressurized "red" (danger) indicator ball 203 to its pressurized "green" or safe position. Therefore, pressurized noncontaminated air will flow through the hose 90 to the mouthpiece or face mask of the user from the tank 40 and the "green" indication of the indicator ball 203 will reflect a "safe" time period of use co-extensive with the amount of air in the auxiliary portable compressed air tank 40 even though the line 60 is totally fractured. The interior of the protective suit 20 will not be pressurized by the air from the tank 40 because, of course, the air from the tank 40 entering into the chamber 112 from the port 130, as heretofore described, cannot enter the bore 121 which is a prerequisite for air to enter the bore 154 (FIG. 3) to subsequently enter the over-pressurization hose 80. Thus, under emergency conditions, such as the breakage of the primary hose 60, the air from the secondary source 40 is limited strictly to the inhalation hose 90 for life-support breathing purposes of the user. This allows the user to, obviously, spend the 10 to 15 minutes emergency air time permitted by the air source 40 to exit whatever might be the danger area, quite possibly repair the primary hose 60, or take whatever precautionary action is required under the circumstances.

Although a preferred embodiment of the invention has been specifically illustrated and described herein, it is to be understood that minor variations may be made in the apparatus without departing from the spirit and scope of the invention, as defined the appended claims.

What is claimed is:

1. A breathing apparatus comprising first and second sources of air; a protective suit having an interior, an inhalation port and valve means for controlling the flow of air relative to said first and second air sources, said protective suit and said inhalation port; first, second, third and fourth conduit means each connected to said valve means and respectively to said first air source, said second air source, said protective suit interior and said inhalation port; said valve means being constructed and arranged to conduct air from said first air source to said protective suit interior and said inhalation port while preventing air flow from said second air source in a first mode of operation; and said valve means being constructed and arranged to conduct air from said second air source to said inhalation port while preventing air flow into said protective suit interior and from said first air source beyond said valve means in a second mode of operation.

2. The breathing apparatus as defined in claim 1 including a manually operable means for switching said valve means between said first and second modes of operation.

3. The breathing apparatus as defined in claim 1 including a single manually operable means for switching said valve means between said first and second modes of operation.

4. The breathing apparatus as defined in claim 1 including a manually slidable means for switching said valve means between said first and second modes of operation.

5. The breathing apparatus as defined in claim 1 including a manually reciprocally slidable means for switching said valve means between said first and second modes of operation.

6. The breathing apparatus as defined in claim 1 including a single slidable means for switching said valve means between said first and second modes of operation.

7. The breathing apparatus as defined in claim 1 including a single reciprocally slidable means for switching said valve means between said first and second modes of operation.

8. The breathing apparatus as defined in claim I including means in said first conduit means for adjustably regulating the air pressure flowing therethrough to said valve means.

9. The breathing apparatus as defined in claim 1 including means for indicating a break in said first conduit means.

10. The breathing apparatus as defined in claim I including means for visually indicating a break in said first conduit means.

11. The breathing apparatus as defined in claim 1 wherein said second air source is a portable compressed air tank carried by a wearer of said protective suit.

12. The breathing apparatus as defined in claim 1 including quick connect/disconnect means for connecting/disconnecting at least one of said first through fourth conduit means relative to said valve means.

13. The breathing apparatus as defined in claim I wherein said valve means is denied by a single valve member.

14. The breathing apparatus as defined in claim 1 wherein said valve means is denied by a single valve member having two valve heads.

15. The breathing apparatus as defined in claim I wherein said valve means is denied by a single valve member disposed for movement relatively normal to manually operable means for switching said valve means between said first and second modes of operation.

16. The breathing apparatus as defined in claim 1 including means for indicating at least the first mode of operation of said valve.

17. The breathing apparatus as defined in claim I including mean for indicating at least the second mode of operation of said valve.

18. The breathing apparatus as defined in claim I including means for indicating the first and second modes of operation of said valve.

19. The breathing apparatus as defined in claim 1 including a plurality of bores associated with said conduit means and valve means, said bores have axes, at least two of said bore axes are generally normal to each other, and at least two other of said bore axes are generally coincident to each other.

20. The breathing apparatus as defined in claim 2 including means in said first conduit means for adjustably regulating the air pressure flowing therethrough to said valve means.

21. The breathing apparatus as defined in claim 2 including means for indicating a break in said first conduit means.

22. The breathing apparatus as defined in claim 2 wherein said second air source is a portable compressed air tank carried by a wearer of said protective suit.

23. The breathing apparatus as defined in claim 2 wherein said valve means is denied by a single valve member.

24. The breathing apparatus as defined in claim 2 including a plurality of bores associated with said conduit means and valve means, said bores have axes, at least two of said bore axes are generally normal to each other, and at least two other of said bore axes are generally coincident to each other.

25. The breathing apparatus as defined in claim 5 including means in said first conduit means for adjustably regulating the air pressure flowing therethrough to said valve means.

26. The breathing apparatus as defined in claim 5 including means for indicating a break in said first conduit means.

27. The breathing apparatus as defined in claim 5 wherein said valve means is denied by a single valve member.

28. The breathing apparatus as defined in claim 5 wherein said valve means is denied by a single valve member disposed for movement relatively normal to manually operable means for switching said valve means between said first and second modes of operation.

29. The breathing apparatus as defined in claim 5 including a plurality of bores associated with said conduit means and valve means, said bores have axes, at least two of said bore axes are generally normal to each other, and at least two other of said bore axes are generally coincident to each other.

30. The breathing apparatus as defined in claim 5 wherein said valve means is denied by a single valve member having two valve heads.

* * * * *